United States Patent [19]

Pollack

[11] Patent Number: 4,645,467

[45] Date of Patent: Feb. 24, 1987

[54] DETACHABLE MOORING AND CARGO TRANSFER SYSTEM

[75] Inventor: Jack Pollack, Reseda, Calif.

[73] Assignee: Amtel, Inc., Providence, R.I.

[21] Appl. No.: 720,040

[22] Filed: Apr. 5, 1985

Related U.S. Application Data

[63] Continuation-in-part of Ser. No. 603,434, Apr. 24, 1984.

[51] Int. Cl.[4] ..... B63B 21/52

[52] U.S. Cl. ..... 441/4; 114/230; 141/387

[58] Field of Search ..... 441/3, 4, 5; 114/230; 141/279, 382, 387, 384, 284, 280, 98, 231, 369–371

[56] References Cited

U.S. PATENT DOCUMENTS

| | | | |
|---|---|---|---|
| 3,583,445 | 6/1971 | Harbonn | 141/382 |
| 3,834,432 | 9/1974 | Lily, Jr. et al. | 141/279 |
| 4,023,517 | 5/1977 | Ruan | 441/5 |
| 4,086,865 | 5/1978 | Statham | 114/230 |
| 4,207,639 | 6/1980 | Nguyen | 441/3 |
| 4,281,614 | 8/1981 | McNary et al. | 114/230 |
| 4,416,306 | 11/1983 | Le Devehat | 141/387 |
| 4,490,121 | 12/1984 | Coppens et al. | 114/230 |

*Primary Examiner*—Trygve M. Blix
*Assistant Examiner*—Edwin L. Swinehart
*Attorney, Agent, or Firm*—Freilich, Hornbaker, Rosen & Fernandez

[57] ABSTRACT

An improved offshore terminal is described, of the type that includes a riser loosely anchored at the sea floor so its upper end can extend from a deep underwater level up to the surface to moor a tanker and transfer hydrocarbons to it. A weight hangs from the lower end of the column to improved dynamic mooring and, where the riser is disconnected to limit the sink depth of the riser. For movement to the deployed position, the riser is lifted by extending a line downwardly from a winch on the vessel, through a central hole in the connector frame down to the top of the riser, the line being pulled to raise the riser until its upper end lies within the central hole of the connector frame. A perforated upper portion of the riser then is in fluid communication with the inner portion of a fluid swivel, so that hydrocarbons can pass out of a conduit within the riser and into the swivel.

2 Claims, 5 Drawing Figures

DETACHABLE MOORING AND CARGO TRANSFER SYSTEM

CROSS-REFERENCE TO RELATED APPLICATION

This is a continuation-in-part of U.S. application Ser. No. 603,434 filed Apr. 24, 1984.

BACKGROUND OF THE INVENTION

Hydrocarbons can be transferred from an undersea pipeline, such as one which leads to undersea wells, to tankers at the sea surface, by a variety of types of offshore terminals. Under severe environmental conditions, such as where there are intrusions of ice packs as well as severe storms, it is desirable to enable a tanker to disconnect from the terminal to sail away, while much of the terminal sinks a considerable depth below the sea surface to lie free of much of the severe environmental conditions. One type of offshore terminal which can be used under these conditions includes a riser having a lower end that is loosely anchored to the sea floor, as through a group of catenary chains. The chains hold the riser deep under water but above the sea floor, while enabling the riser to be easily lifted up to the vessel. Improvements in such a system which facilitated connection of the top of the riser to the vessel and which provided improved mooring at minimal cost, would be of considerable value.

SUMMARY OF THE INVENTION

In accordance with one embodiment of the present invention, an offshore terminal is provided, of a type which includes a riser that is loosely anchored as by chains, which can facilitate the dynamics of anchoring. In a detachable riser, the riser can be lifted by a line that extends through a central hole in the connector frame, to lift the upper end of the riser into the central hole. The lifting can continue until a portion of the riser with at least one sidewardly-facing hole therein lies at the same level as the holes in the inner portion of a fluid swivel or PDU (product distribution unit) that is held to the vessel. The riser can extend most of the height of the sea and have a lower end that is weighted, to provide better mooring dynamics. The weight can include a clump weight hanging from the lower end of the riser.

The novel features of the invention are set forth with particularity in the appended claims. The invention will be best understood from the following description when read in conjunction with the accompanying drawings.

DESCRIPTION OF THE PREFERRED EMBODIMENT

Figure 1:
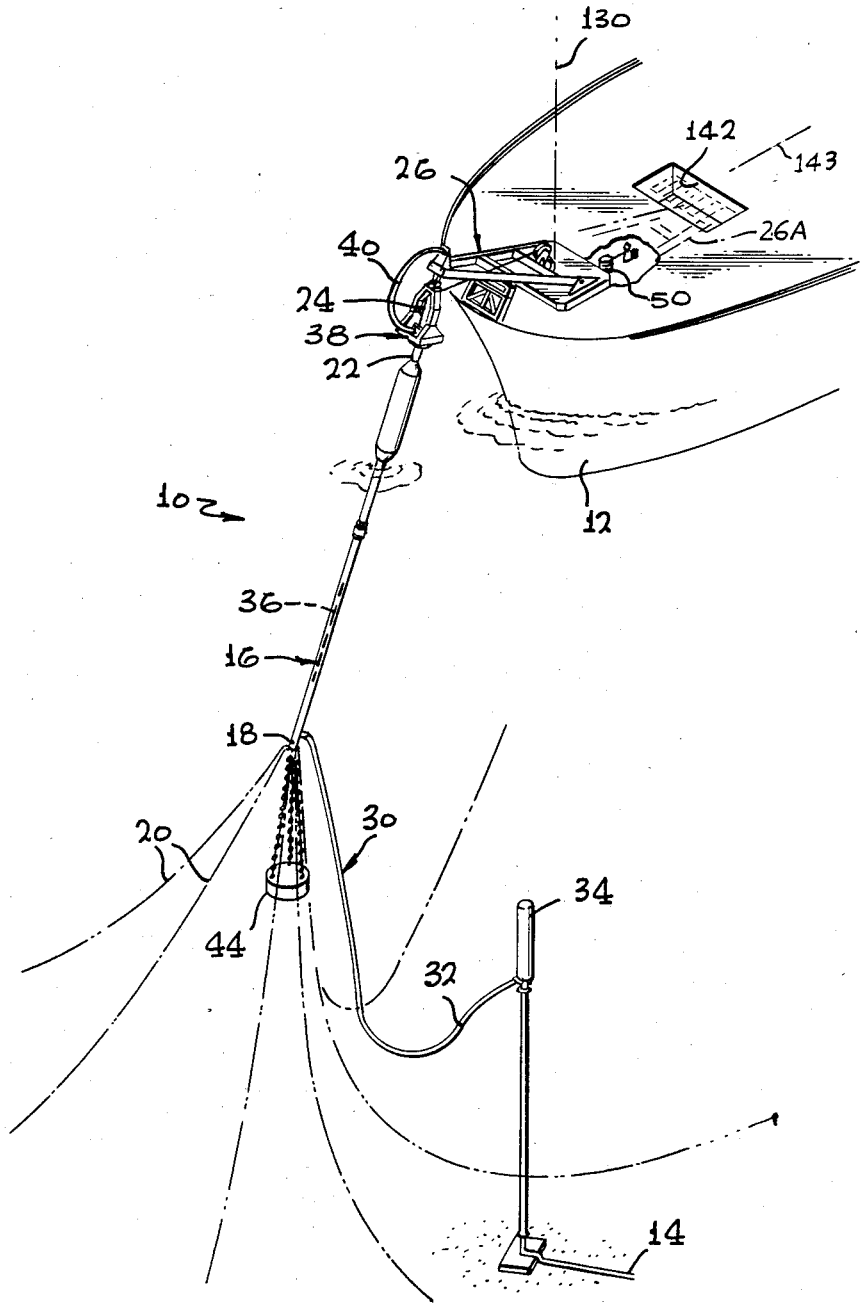
FIG. 1 is a perspective view of an offshore terminal constructed in accordance with the present invention, shown with the riser connected to the vessel.

FIG. 1 illustrates an offshore terminal system 10 for mooring a vessel 12 such as a tanker and for transferring cargo such as hydrocarbons between a pipeline 14 at the seafloor and the vessel. The system includes a riser 16 which has a base or lower end 18 anchored by a group of catenary chains 20 that extend in catenary curves in different compass, or horizontal, directions to the sea floor and along the sea floor to anchor locations. The upper end 20 of the riser includes a riser head 22 which is connected through a mooring riser connector frame 24 and a mooring boom 26 to the vessel. Hydrocarbons pass from the pipeline 14 up to the vessel through a conduit 30 which includes a submarine hose 32 held off the sea bottom by a buoy 34, a solid pipe 36 that extends through the riser, a fluid swivel unit 38 at the top of the riser and a jumper hose 40 that connects to piping leading to the vessel.

The system is designed for use in regions that are sometimes subjected to severe environmental conditions, such as where there are icepacks and/or severe storms that would endanger a vessel. In the event of such conditions, the riser 16 can be disconnected from the vessel 12 and the vessel can be sailed away. The riser then sinks to the orientation shown in FIG. 2 at 16*a*, wherein the upper end 20 of the riser lies at a depth D which is sufficient to isolate it from the effects of the severe weather conditions and also so that it lies under the deepest draft of a tanker hull 12 that is designed to move to the terminal. To avoid damage to the submarine hose and the riser, the bottom 18 of the riser is maintained in position above the sea floor by the riser buoyancy, the weight of portions of the catenary chains, and by a weight 44 that hangs straight down from the bottom of the riser and which is supported on the sea floor. A buoyancy chamber 46 near the top of the riser provides sufficient buoyancy to support the weight of the riser and the suspended portion of the catenary chains, and maintains the riser in a substantially vertical position.

Figure 4:
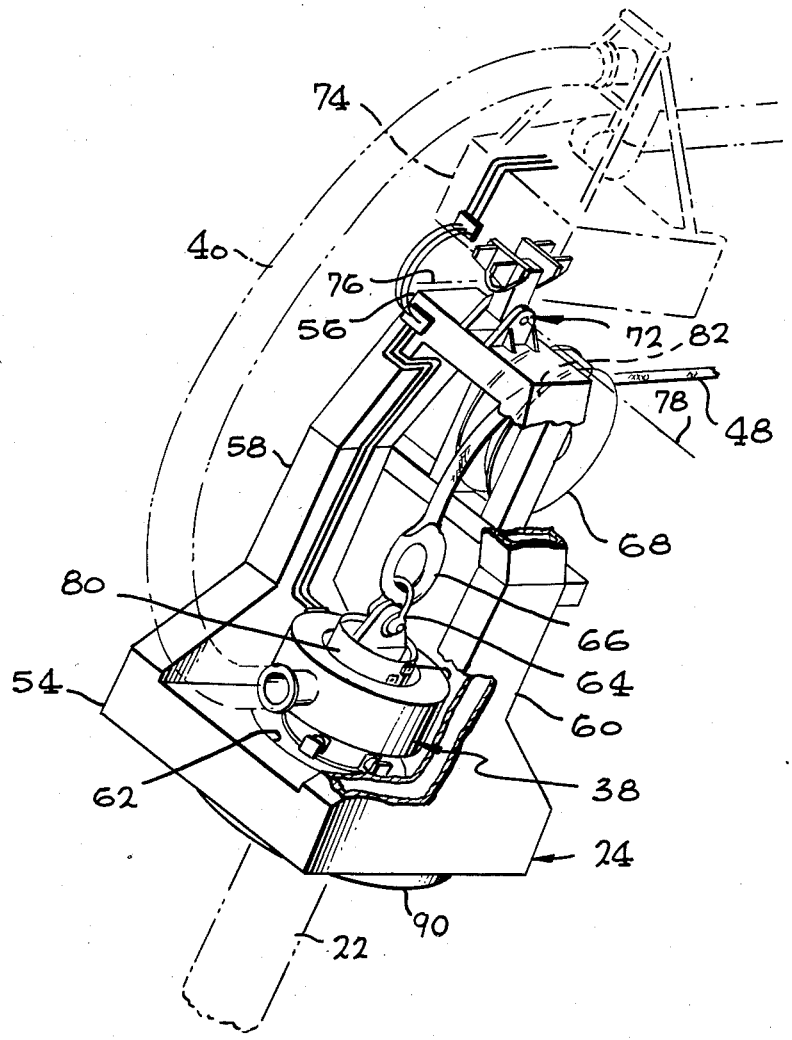
FIG. 4 is a perspective view of a mooring riser connector frame assembly of the system of FIG. 1, shown with the riser in the connected position.

When a vessel 12 sails to the region of the terminal, an in-haul line 48 that is attached to the top of the riser is picked up by the vessel, threaded through the connector frame 24, and pulled by a winch 50 on the vessel. As the riser is pulled, it aligns itself with the connector frame 24 while the frame 24 aligns itself with the riser as at 16*b*. The riser is finally pulled up to the position shown in phantom lines at 16. As shown in FIG. 4, the mooring riser connector frame 24 includes a lower end 54, an upper end 56, and a pair of legs 58, 60 that connect them, with portions of the leg 60 cut away in FIG. 4. The bottom 54 of the frame has a central or riser-receiving hole 62 which receives the upper end 22 of the riser, to transmit large forces through the riser for mooring of the vessel and to provide a fluid coupling between a pipe extending within the riser and the fluid swivel or product distribution unit 38. The extreme upper end of the riser carries an in-haul line attaching means in the form of a shackel 64. A thimble 66 at an end of the in-haul line 48 extends from the shackel and around a sheave 68 (and additional sheaves) to a mooring winch (shown at 50 in FIGS. 1 and 2). The upper end 56 (FIG. 4) of the connector frame is coupled through a universal joint 72 to an outer end of the boom. The universal joint permits pivoting of the frame relative to the boom about two largely horizontal axes 76, 78.

When the riser is being pulled upward, the line 48 extends through a central hole guide 90 and a sleeve 80 (FIG. 4) within the central hole 62 of the connector frame. The central hole guide 90 is closer to the lower end of the frame 24 than its upper end where it connects to the universal joint 72, which tends to align the largely vertical axis of the central hole 62 with the length of the riser. However, since the tensioned line extends around the sheave 68 (so that the line can extend largely horizontally therefrom to the winch on the vessel), there is considerable force on the line against a forward upward location 82 on the periphery of the sheave. This force produces a torque that tends to pivot the connector frame to extend vertically rather than at an angle to align itself with the riser that is being pulled up. However, the sheave is mounted much closer to the top of the frame 24 near the universal joint 72, than the bottom, so the misaligning torque is minimal. The location 82 is spaced from the joint 72 by less than one-fourth the height of the frame.

Figure 5:
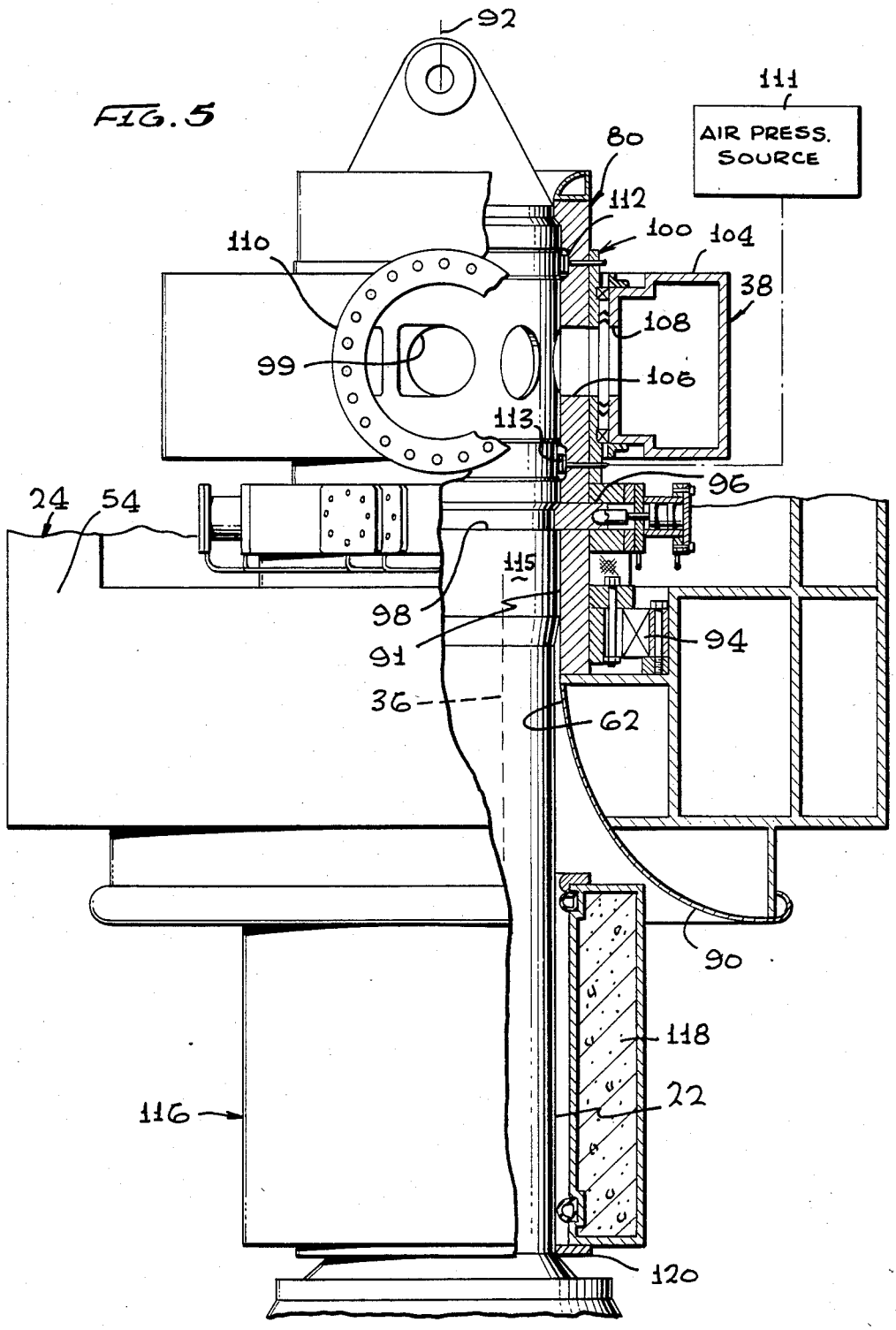
FIG. 5 is a sectional view of a portion of the connector frame and riser of FIG. 4.

FIG. 5 shows details of the coupling of the upper end of the riser, at the riser head 22 thereof, to apparatus at the lower end 54 of the connector frame. As the riser is pulled up into the connector frame, it is guided by the concave and largely cone-shaped central hole guide 90 having a progressively greater width at progressively lower locations thereon. The guide 90 moves the riser into a riser-receiving hole 91 in the sleeve 80 of the connector frame assembly, which is aligned with the central hole 62 of the frame. The sleeve 80 is rotatably mounted about a largely vertical axis 92 that passes through the central hole of the frame, by a bearing 94. When the head 22 at the top of the riser is fully received within the connector frame, latch dogs 96 are hydraulically actuated to fit into a latch groove 98 in the riser to lock the riser in the sleeve and therefore in a fixed position within the connector frame. While the bearing 94 must withstand considerable vertical forces to support much of the riser weight, it does not have to withstand considerable torque tending to turn the riser about horizontal axes, since the connector frame can follow such turning of the riser because of its mounting by a universal joint on the boom.

The riser head has fluid ports 99 that are connected to the pipe 36 within the riser through which hydrocarbons flow. The sleeve 80 and a ring form the nonrotatable inner portion of the fluid swivel unit or PDU (product distribution unit) 38 through which the hydrocarbons pass in moving to the tanker. The fluid swivel also includes a rotatable outer portion 104. The term nonrotatable for the inner swivel portion at 100 is used merely to indicate that it does not turn without limit about a vertical axis, although it can turn to some extent as the riser twists; the outer portion 104 is rotatable without limit as the vessel drifts about the terminal. Ports or holes 106 and 108 in the inner and outer swivel portions communicate with the fluid ports 99 in the top of the riser, to enable the flow of hydrocarbons to the outer portion 104 of the fluid swivel unit, and from there through a jumper hose flange 110 and the hose (40 in FIG. 1) to the tanker.

The portion of the sleeve 80 (FIG. 5) which forms the inner fluid swivel portion 100, is sealed to the riser by a pair of inflatable seals 112, 113 with one seal lying above and the other below the fluid ports 98 and holes 106. The seals 112 which lie in grooves, are initially not inflated as the riser is pulled up, to avoid damage to the seals. Once the riser is at a level where it is locked in place by the dogs 96, pressured fluid such as air from a source 111 is applied to the seals 112 to inflate them, to a pressure that is higher than the pressure of the hydrocarbons passing through the fluid swivel. Each seal includes a hollow ring-shaped inflatable member that extends around the riser.

In some situations, where it is desired to protect the cylindrical upper region 115 of the riser head 22, where the fluid ports 99 are located, a protective sleeve 116 can be provided. The protective sleeve includes a ring 118 of foam which makes the sleeve highly buoyant. When the top of the riser lies under water, the buoyancy of the sleeve urges it upwardly until a lower guide ring and stop 120 prevents further upward movement of the sleeve and the sleeve covers the fluid ports 99. As the riser is pulled out of the water during its deployment to a use condition, the sleeve 116 slides down along the riser head to scrape away barnacles or other deposits on the head, while also uncovering the top of the head. The guide cone 90 will force the sleeve down if it has not already slid down.

Figure 3:
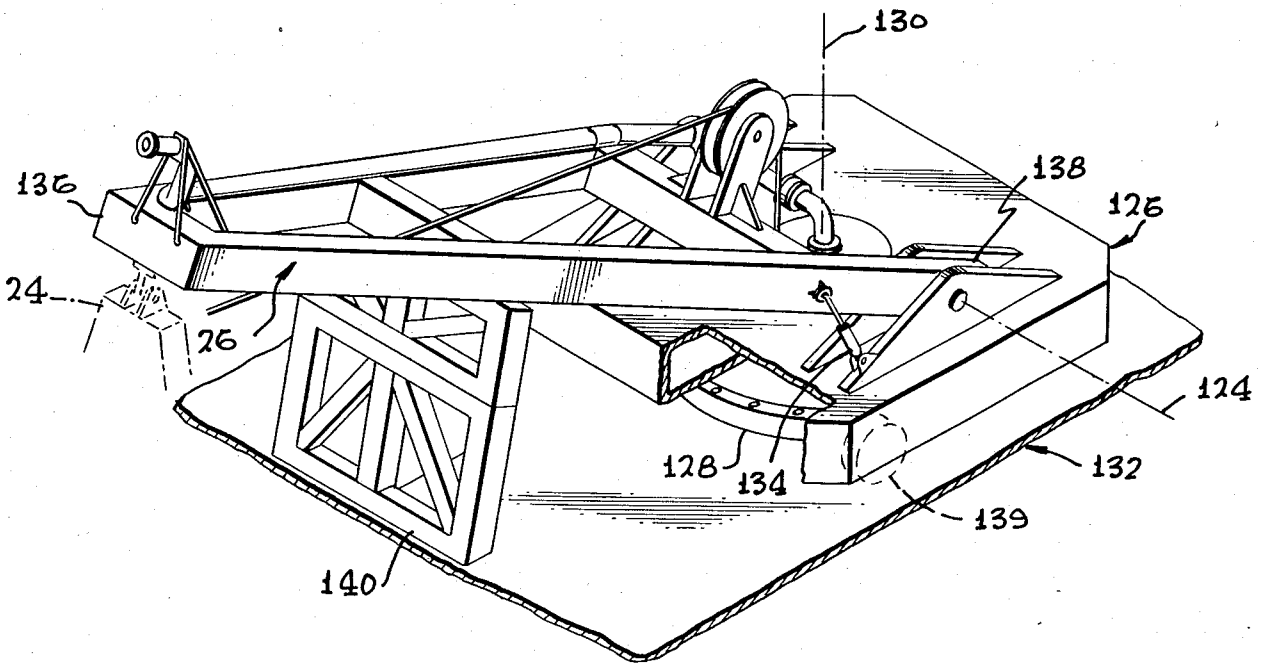
FIG. 3 is a perspective view of a mooring boom of the system of FIG. 1, shown in a deployed position.

The mooring boom 26 shown in FIG. 3 is pivotally mounted about a substantially horizontal axis 124 on a turntable 126. The turntable 126 is rotatably mounted by a bearing assembly 128 about a substantially vertical axis 130 on the forecastle deck 132 of the tanker. Lifting actuators or rams 134 can lift and lower an outer end 136 of the boom 26 whose inner end 138 is mounted through the turntable to the vessel. In the deployed or use position shown in FIG. 3, wherein the outer end 136 of the boom lies outboard of the bow end of the vessel to hold the connector frame assembly 24 beyond the hull of the vessel, the boom is preferably supported by a forward support structure 140. When the riser is disconnected from the vessel so the vessel can sail away, the rams 134 are operated to lift the boom so that it lifts the connector frame assembly 24 above the level of the deck. A motor 139 rotates the turntable and boom by about 180°, so that the outer end of the boom and the connector frame lie inboard of the vessel. The rams 134 are then operated to lower the boom, to lower the connector frame into a locker 142 (FIG. 1) so the boom and connector frame are stably supported. The boom is then in the position shown at 26A. In both the use and stowed positions of the boom, it extends (an imaginary line between its ends extends) primarily along the centerline 143 of the vessel, as seen in a plan view. Of course, the boom could be rigidly fixed in position.

Figure 2:
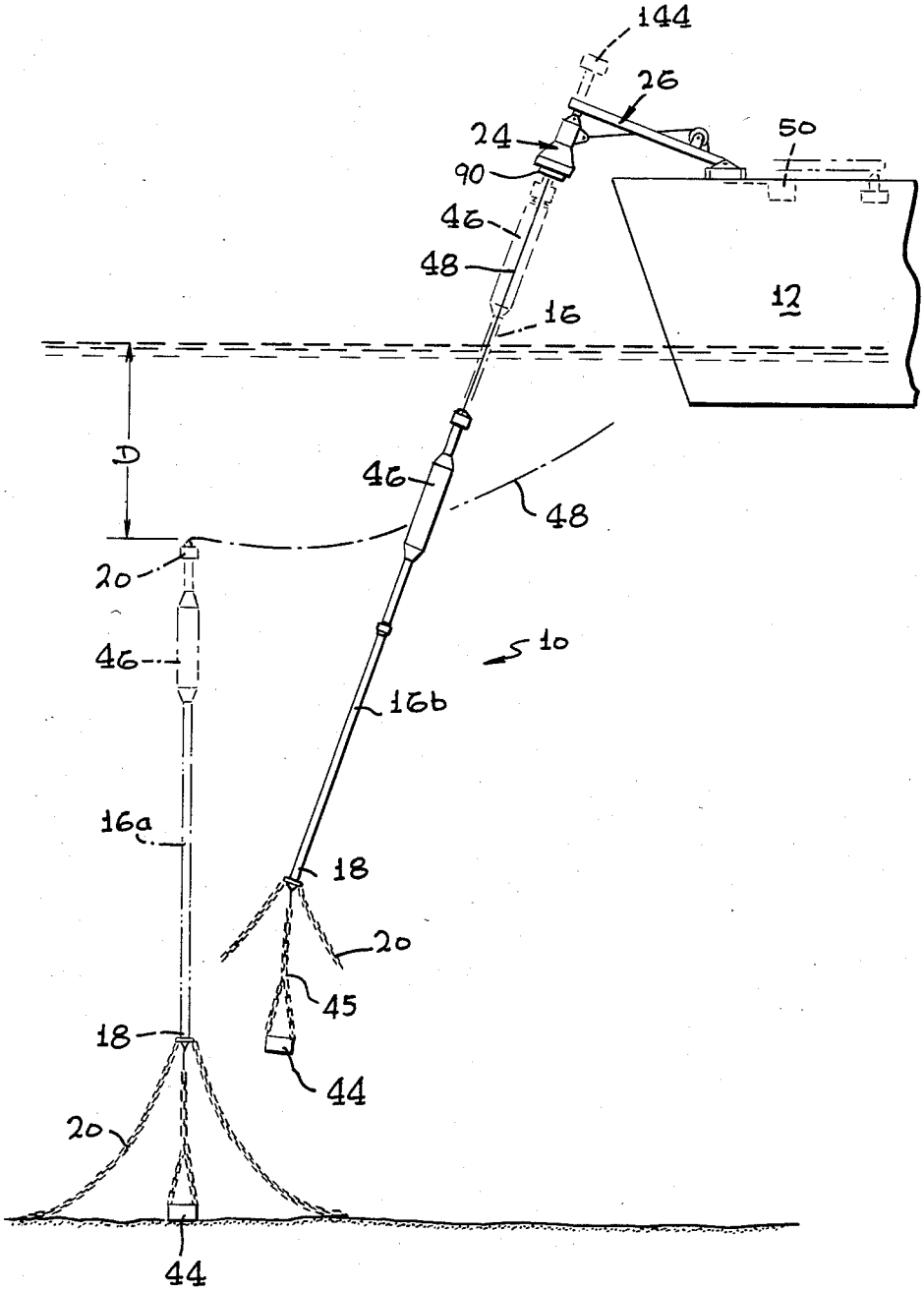
FIG. 2 is a side elevation view of the terminal of FIG. 1, showing various steps in the raising of the riser from a stowed position to a connected position.

During the hauling up of the riser, as shown in FIG. 2, from the position **16*b* to the position 16, there can be considerable friction of the in-haul line 48 on the connector frame 24, because the connector frame 24 tends to hang downwardly and only tension in the line 48 pivots the connector frame into alignment with the riser. Such tension in the line can be reduced by the use of a counterweight indicated at 144 that is fixed to the frame 24, so that a minimal torque is required to pivot the frame into alignment with the The length of the riser 14 is preferably at least about ½ the depth of the sea, and the bottom of the riser is heavily weighted especially by the hanging weight 44, to provide good dynamic mooring of a drifting vessel. When the vessel drifts as to the position shown in FIG. 2, the riser tilts and its lower end moves in the direction of vessel drift. The tilting riser acts like a long pendulum with a heavy weight at its bottom, which tends to pivot back towards the vertical. If the riser has a small height which is much less than half the height of the sea, then only the chains 20 will serve to urge the vessel back. This would require very heavy chains. The clump weight 44 hanging from the lower end of the column, combined with a long column at least about ½ the sea depth, enables light weight chains 20 to be used. The weight 44 is suspended by a hanger 45 which may be a chain to permit the weight 4 to swing relative to the bottom of the column, and also to permit some collapse of the hanger 45 when the column at 16***a* in FIG. 2 moves low enough that the hanger 45 is collapsed slightly (i.e. a chain hanger would be limp). It can be seen that the hanger has a height greater than that of the weight, to permit such collapse.

One offshore terminal design is for the production of hydrocarbons in a region threatened by ice flows in the winter and also by severe storm conditions, where the depth of the sea is about 250 feet. The riser is designed for use, under the worse conditions, with a 120,000 ton dead weight tanker that is fully laden. The riser has a length of 141 feet, a buoyancy chamber length of 39 feet and diameter of 8 feet, and a riser diameter of 4 feet.

With the riser free to sink, its bottom would float 40 feet above the sea floor. When subjected to maximum operational loading, the tanker would move 135 feet from a neutral position, and the riser would then be inclined at 35° from the vertical. The hydrocarbons would be expected to reach a pressure of 225 psi at the top of the riser, and the inflatable seals 112 were to be inflated to approximately 350 psi.

Thus, the invention provides an offshore terminal of the type which includes a riser having a lower end loosely anchored to the sea floor, which provides efficient mooring and which enables connection and disconnection from a vessel. A weight hung from the bottom of a tall riser, provides a pendulum effect in mooring a vessel and limits the submersion depth of a disconnected riser. Minimum modification to the vessel is required because connection is made through a connector frame held outboard of an end of the vessel by a boom, so that no major modification of the vessel hull is required. When not moored, the boom can be swung about 180°, so its outer end and the connector frame attached thereto lie well within the vessel and can be stored thereat. The terminal, which includes a riser whose lower end is loosely anchored to the sea floor so that it can be raised from a deep underwater depth to a position where its upper end is above sea level, has at least one flow port near its upper end through which oil can flow into a fluid swivel held at the connector frame. THe connector frame includes a fluid swivel with an inner end portion that receives the perforated portion of the riser and which can turn with it.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. An offshore system for mooring a vessel in a sea comprising:

a vessel;

a riser having a height and having an upper end and a lower end, the height of the riser being more than one half the height of the sea;

means coupling the upper end of said riser to said vessel for permitting the riser to pivot about a pair of horizontal axes relative to the vessel;

a plurality of chains having upper ends coupled to the lower end of said riser, said chains extending in loose catenary curves to the sea floor; and a weight having a negative buoyancy and at least one chain device having an upper end coupled to the lower end of said riser and a lower end connected to said weight to hang the weight from the riser;

said riser and weight, as a combination, have a negative buoyancy;

the lower half of said riser being free of attachment to any buoyant body having a greater positive buoyancy than the negative buoyancy of said weight, and the lower end of said riser being free to move in every direction with restraint substantially only by said chains.

2. In an offshore terminal for mooring a vessel having bow and stern ends and which floats at the sea surface, and for transferring hydrocarbons between the vessel and a pipe at the sea floor, which includes a riser having a lower end anchored to the sea floor by a plurality of catenary chains or the like which permit the top of the riser to be pulled up and coupled to the vessel and which limit the depth of riser submersion when the riser is released from the vessel to sink, the improvement comprising:

a boom having inner and outer ends;

a connector frame for connecting the outer end of said boom to the top of the riser; and means for pivotally mounting said boom about a largely vertical axis on a location inboard of said vessel near an end thereof for enabling said boom to move between a deployed position wherein said outer end of said boom extends beyond said end of said vessel and a stored position wherein said outer end of said boom lies at a location inboard of said vessel and at an orientation largely 180° about said vertical axis from its orientation in the deployed position as seen in a plan view.

* * * * *